US006318712B1

(12) United States Patent
Coffman

(10) Patent No.: US 6,318,712 B1
(45) Date of Patent: Nov. 20, 2001

(54) ANGLE GLUING CLAMP

(76) Inventor: Randall R. Coffman, 1500 River Circle Dr., Richmond, KY (US) 40475-7907

( * ) Notice: Subject to any disclaimer, the term of this patent is extended or adjusted under 35 U.S.C. 154(b) by 0 days.

(21) Appl. No.: 09/699,714

(22) Filed: Oct. 30, 2000

(51) Int. Cl.[7] ..... B25B 1/20
(52) U.S. Cl. ..... 269/41
(58) Field of Search ..... 269/41, 37, 6, 269/228, 902, 268, 257

(56) References Cited

U.S. PATENT DOCUMENTS 112,801 3/1871 Good .
4,033,570 7/1977 Curlow .
4,165,869 8/1979 Williams .
4,984,775 1/1991 Kahlke .
5,494,553 2/1996 Colucci .

*Primary Examiner*—Robert C. Watson
(74) *Attorney, Agent, or Firm*—Lee, Mann, Smith, McWilliams, Sweeney & Ohlson

(57) ABSTRACT

A clamp for maintaining two butting segments in an adjoining relationship. First and second outer clamp members are adjustably secured to an angle inner clamp member. The spacing between the outer clamp members and the inner clamp members can be adjusted, and an operating element is provided for each outer clamp member for clamping purposes. An access aperture is located in the inner clamp member to permit access to the juncture between the two butting segments.

19 Claims, 1 Drawing Sheet

ANGLE GLUING CLAMP

BACKGROUND OF THE INVENTION

This invention relates to clamping of two pieces or segments in an adjoining relationship, and more particularly to a clamp for maintaining a butting relationship between the two segments so that the segments can be glued or otherwise joined to one another.

When joining two flat segments, such as pieces of plastic, to one another, it is necessary to maintain those pieces in that relationship temporarily so that they can be glued or otherwise joined at their junction. Typically the pieces are joined at a 90 degree angle to one another, although obviously, no matter what the angle of juncture, it is important that the pieces be held stably until the gluing process has been completed.

Various devices have been developed in the past for such juncture. For example, U.S. Pat. No. 112,801 discloses an angle vice for joining two parts together. Similarly, U.S. Pat. No. 4,033,570 discloses a simple corner clamp for securing parts together. Similarly, a more complex comer clamp is disclosed in U.S. Pat. No. 4,984,775.

While the prior art provides devices that have utility, those devices tend not to have universal utility for use in all clamping situations. They also, because of their constructions, tend to make application of glue to join pieces very difficult unless the glue is applied before the pieces are joined. That may be unfeasible in many situations.

SUMMARY OF THE INVENTION

The invention provides a clamp for maintaining two butting segments in an adjoining relationship to one another. It includes an inner clamp member and first and second outer clamp members, with each outer clamp member being adjustably secured to the inner clamp member. An operating element for each outer clamp member is provided for moveably positioning the outer clamp member in relation to the inner clamp member. A spacing element for each outer clamp member is provided for adjustably maintaining a gap between the outer clamp member and the inner clamp member, with the spacing element being offset from the operating element.

In accordance with the preferred form of the invention, each operating element comprises a bolt which extends from the inner clamp member through an aperture in the outer clamp member. An adjustable fastener is mounted on the bolt proximate the outer clamp member. In the preferred form of the invention, the adjustable fastener comprises a nut, which preferably is knurled.

Each spacing element comprises a bolt extending from the inner clamp member through the outer clamp member, and a spacer engaged by the bolt. In accordance with the preferred form of the invention, the spacer comprises a first nut on the bolt which is located between the inner clamp member and the outer clamp member and a second nut on the bolt which is secured to the outer clamp member. In the illustrated embodiment, the outer clamp member includes a cavity, and the second nut is located in the cavity.

An access aperture is provided in the inner clamp member spaced from the operating element to allow access to the juncture between joined segments. In the preferred form of the invention, the inner clamp member is angled longitudinally through the access aperture, and a chamfer is located adjacent the access aperture.

The clamp members can adjoin one another directly. Preferably, however, a clamp pad is located between each outer clamp member and the inner clamp member for protecting the segments being joined to one another.

In accordance with the disclosed form of the invention, the inner clamp member is formed at a 90 degree angle, with first and second clamp portions joined at that angle. The inner clamp member can be formed at other angles, and the juncture between the first and second clamp portions can be formed to be adjustable.

BRIEF DESCRIPTION OF THE DRAWING

The invention is described in greater detail in the following description of an example embodying the best mode of the invention, taking in conjunction with the drawing figures, in which.

DESCRIPTION OF AN EXAMPLE EMBODYING THE BEST MODE OF THE INVENTION

Figure 1:
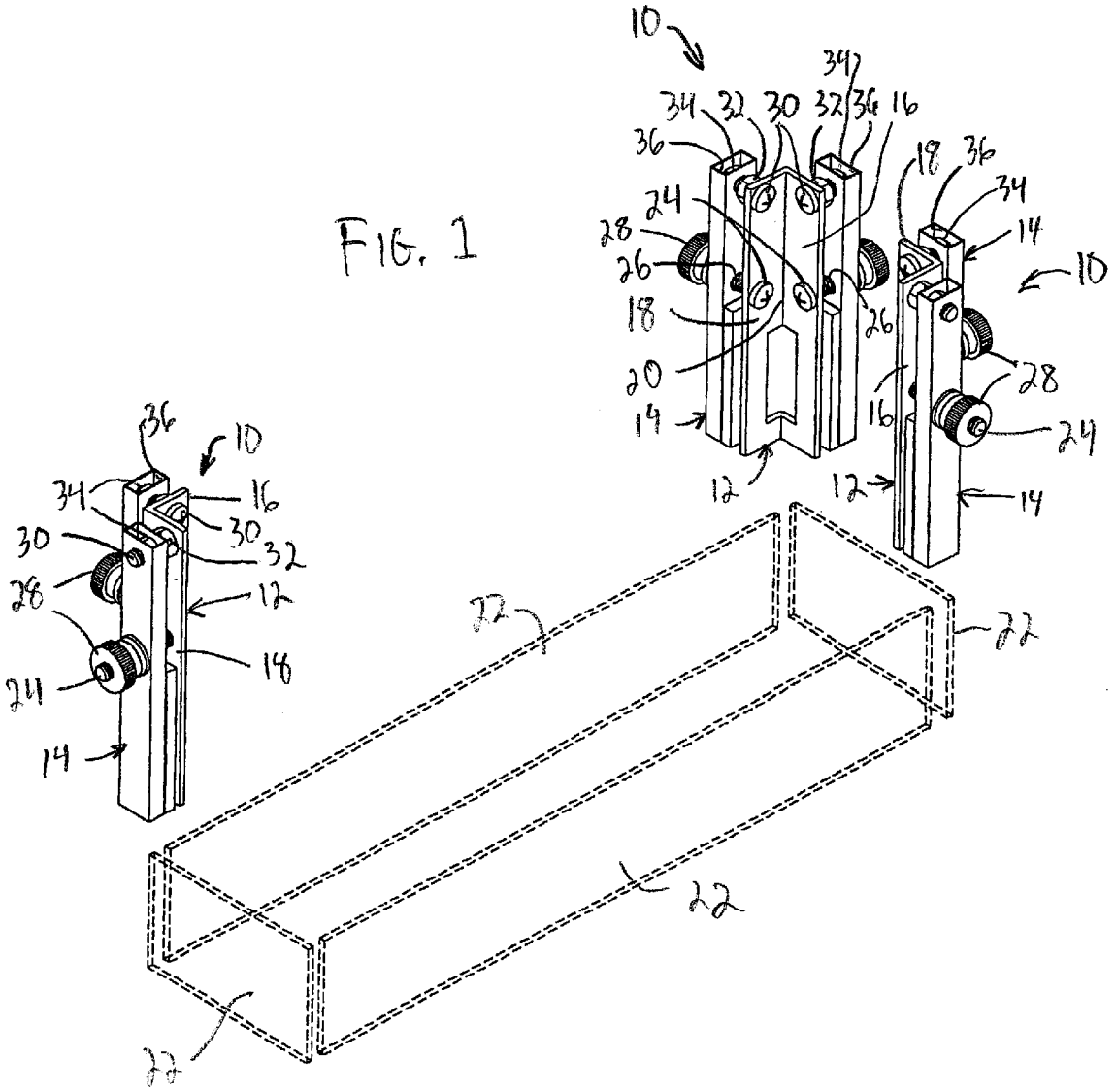
FIG. 1 is a partially exploded perspective view of three clamps according to the invention, when disposed in relation to butting segments that are to be joined.
Figure 2:
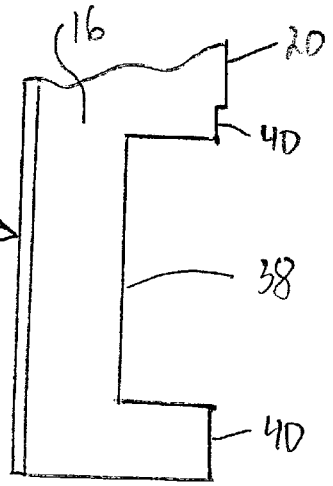
FIG. 2 is an enlarged elevational illustration of a portion of the inner clamp member, showing the access aperture and chamfer at the access aperture at the junction of the first and second clamp portions of the inner clamp member.

A clamp according to the invention is shown generally at 10 in the drawing figures. The clamp 10 comprises two basic portions, an inner clamp member 12 and a pair of outer clamp members 14. The outer clamp members 14 are adjustably secured to the inner clamp member 12, as described in greater detail below.

The inner clamp member 16 is composed of first and second clamp portions 16 and 18 which may be disposed at any angle to one another. As shown in the drawing figures, the clamp portions 16 and 18 adjoin along a junction 20, which can be a permanent junction (thus, the inner clamp member is always formed with a particular angle), or which can be adjustable. As shown in the drawing figures, the particular clamps 10 illustrated are formed with the inner clamp member 12 having the clamp portions 16 and 18 at a right angle, so that segments 22, such as pieces of plastic, can be joined to one another at right angles, as well.

An operating element is provided for movably positioning each outer clamp member in relation to the inner clamp member. As shown in the drawing figures, the operating element preferably comprises a bolt 24 which extends from the inner clamp member through an aperture 26 in each outer clamp member 14. An adjustable fastener in the form of a knurled nut 28 is threadedly secured on each bolt 24 proximate the outer clamp member 14. Thus, by judicious adjustment of the nut 28 on the bolt 24, the outer clamp member 14 can be drawn toward the inner clamp member 12 to clamp segments 22 therebetween.

A spacing element is also provided for each outer clamp member 14 to adjustably maintain a gap between the outer clamp member 14 and the inner clamp member 12. Each spacing element comprises a bolt 30 extending from the inner clamp member 12 through the outer clamp member 14. A spacer is engaged by the bolt 30, and in the form of the invention illustrated in the drawing figures, the spacer comprises a first nut 32 located on the bolt 30 between the inner clamp member 12 and the outer clamp member 14, and a second nut 34 located on the bolt 30 and secured to the outer clamp member 14. Preferably the second nut 32 is located in a cavity 34 in each of the outer clamp members 14 or alternatively the second nut can actually be a threaded portion of the outer clamp member 14. The spacing element is adjustable to maintain an appropriate gap at one end of the clamp 10, so that when the knurled nut 28 is adjusted on the bolt 24, even pressure is applied to a segment 22 secured between the inner clamp 12 and the outer clamp 14.

When segments 22 are joined, it is important that there be as much access as possible to their juncture. Accordingly, the inner clamp member 12 is formed with an access aperture 38. The access aperture allows easy access to the junction of two segments 22, so that glue can be applied after the segments 22 are secured in place. Similar access is provided between the outer clamp members 14 on the opposite side of the clamp 10.

A chamfer 40 is formed along the junction 20 proximate the access aperture 38. The chamfer 40 accommodates excess material or glue that may have flowed from the junction of two segments 22.

The outer clamp members 14 can be formed to directly contact the inner clamp member 12. Preferably, however, a clamp pad 42 is located between each outer clamp member 14 and the inner clamp member 12. The clamp pad 42 can be affixed to either of the clamp members 12 or 14, and preferably is affixed to the outer clamp member 14.

The clamp according to the invention provides a simple, yet highly effective device for clamping two pieces of material together, while affording full access to the junction of those pieces of material. Various changes can be made to the invention without departing from the spirit thereof or scope of the following claims.

What is claimed is:

1. A clamp for maintaining two butting segments in an adjoining relation to one another, comprising a. an inner clamp member, b. first and second outer clamp members, each said outer clamp member being adjustable secured to said inner clamp member, c. an operating element for each outer clamp member for movably positioning said outer clamp member in relation to said inner clamp member, and d. a spacing element for each outer clamp member for adjustably maintaining a gap between said outer clamp member and said inner clamp member, said spacing element being offset from said operating element.

2. A clamp according to claim 1, in which each said operating element comprises a bolt extending from said inner clamp member through an aperture in said outer clamp member, and including an adjustable fastener on said bolt proximate said outer clamp member.

3. A clamp according to claim 2, in which said fastener comprises a nut.

4. A clamp according to claim 3, in which said nut is knurled.

5. A clamp according to claim 1, in which said spacing element comprises a bolt extending from said inner clamp member through said outer clamp member and a spacer engaged by said bolt.

6. A clamp according to claim 5, in which said spacer comprises a first nut on said bolt and located between said inner clamp member and said outer clamp member, and a second nut on said bolt and secured to said outer clamp member.

7. A clamp according to claim 6, in which said outer clamp member includes a cavity, said second nut being located in said cavity.

8. A clamp according to claim 1, including an access aperture in said inner clamp member, spaced from said operating element.

9. A clamp according to claim 8, in which said inner clamp element is angled longitudinally through said access aperture, and including a chamfer.

10. A clamp according to claim 1, including a clamp pad between each said outer clamp member and said inner clamp member.

11. A clamp for maintaining two butting segments in an angular relation to one another, comprising a. an inner clamp member, said inner clamp member including first and second clamp portions disposed at an angle to each other, b. first and second outer clamp members, each said outer clamp member being adjustable secured to said inner clamp member, said first outer clamp member being proximate said first clamp portion and said second outer clamp member being proximate said second clamp portion, c. an operating element for each outer clamp member for movably positioning said outer clamp member in relation to said inner clamp member, and d. a spacing element for each outer clamp member for adjustably maintaining a gap between said outer clamp member and said inner clamp member, said spacing element being offset from said operating element.

12. A clamp according to claim 11, in which each said operating element comprises a bolt extending from said inner clamp member through an aperture in said outer clamp member, and including an adjustable fastener on said bolt proximate said outer clamp member.

13. A clamp according to claim 12, in which said fastener comprises a nut.

14. A clamp according to claim 11, in which said spacing element comprises a bolt extending from said inner clamp member through said outer clamp member and a spacer engaged by said bolt.

15. A clamp according to claim 14, in which said spacer comprises a first nut on said bolt and located between said inner clamp member and said outer clamp member, and a second nut on said bolt and secured to said outer clamp member.

16. A clamp according to claim 11, including an access aperture in said inner clamp member, spaced from said operating element.

17. A clamp according to claim 16, in which said access aperture extends in both of said first and second clamp portions.

18. A clamp according to claim 17, including a chamfer adjacent said access aperture.

19. A clamp according to claim 11, including a clamp pad between each said outer clamp member and said inner clamp member.

* * * * *